United States Patent [19]

Atal et al.

[11] Patent Number: 4,709,390

[45] Date of Patent: Nov. 24, 1987

[54] SPEECH MESSAGE CODE MODIFYING ARRANGEMENT

[75] Inventors: Bishnu S. Atal, New Providence; Barbara E. Caspers, Saddle River, both of N.J.

[73] Assignee: American Telephone and Telegraph Company, AT&T Bell Laboratories, Murray Hill, N.J.

[21] Appl. No.: 607,164

[22] Filed: May 4, 1984

[51] Int. Cl.[4] ..... G10L 5/00

[52] U.S. Cl. ..... 381/51; 381/38

[58] Field of Search ..... 381/29–40, 381/51–53; 364/513.5

[56] References Cited

U.S. PATENT DOCUMENTS

| | | | |
|---|---|---|---|
| 3,624,302 | 11/1971 | Atal | 381/40 |
| 3,631,520 | 12/1971 | Atal | 381/40 |
| 4,435,831 | 3/1984 | Mozer | 381/30 |
| 4,449,190 | 5/1984 | Flanagan et al. | 381/46 |
| 4,472,832 | 9/1984 | Atal | 381/40 |

*Primary Examiner*—E. S. Matt Kemeny

*Attorney, Agent, or Firm*—Wilford L. Wisner; Jack S. Cubert

[57] ABSTRACT

Natural quality and bit-rate for LPC speech synthesis is improved by encoding the LPC residual signal in a prescribed multipulse format formed for each LPC frame. Voiced, unvoiced, and mixed (hiss plus periodic) excitation is inherent. The speaking-rate is changed by adding, deleting, or repeating pitch-periods, and the pitch (intonation) is changed by adding or deleting zeros in the multipulse excitation signal.

22 Claims, 14 Drawing Figures

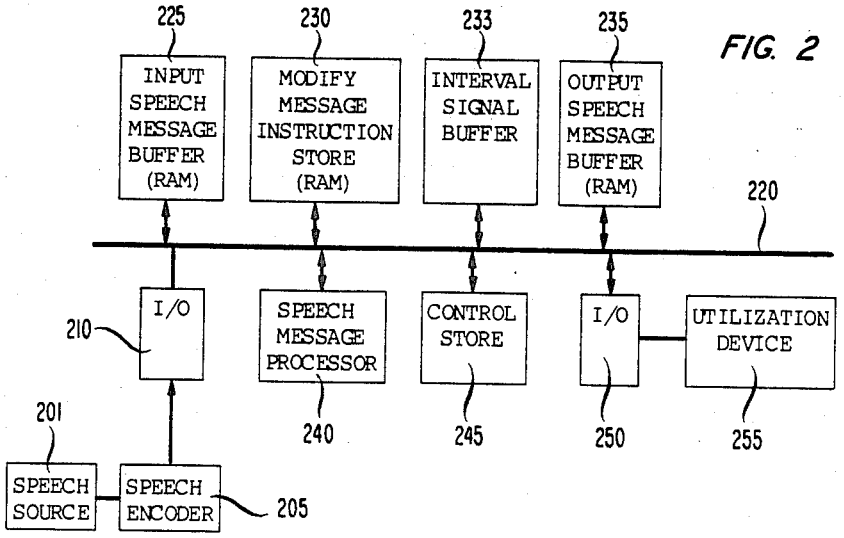
FIG. 2
FIG. 11
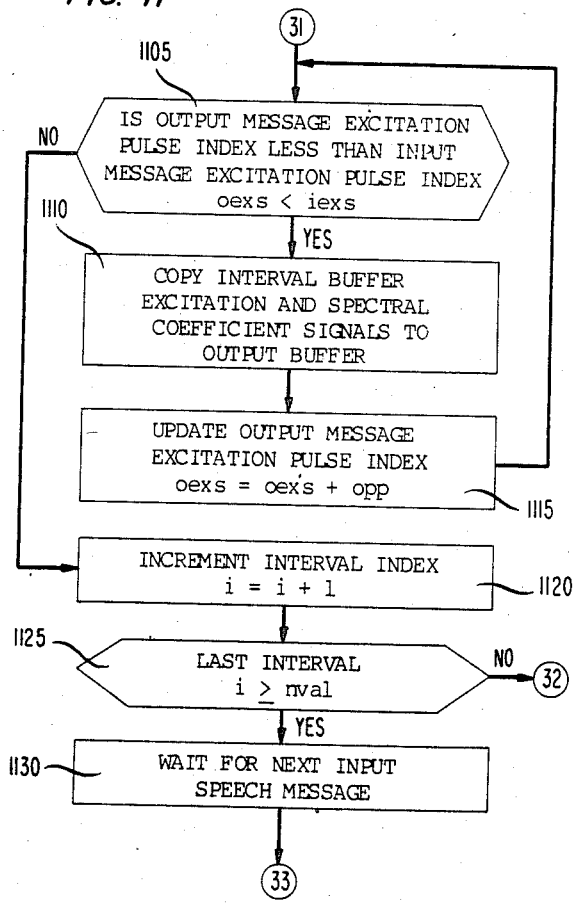

| FIG. 3 | FIG. 4 |
|---|---|

| FIG. 6 | FIG. 7 |
|---|---|

| FIG. 9 | FIG. 10 | FIG. 11 |
|---|---|---|

SPEECH MESSAGE CODE MODIFYING ARRANGEMENT

BACKGROUND OF THE INVENTION

This invention relates to speech coding and more particularly to linear prediction speech pattern coders.

Linear predictive coding (LPC) is used extensively in digital speech transmission, speech recognition and speech synthesis systems which must operate at low bit rates. The efficiency of LPC arrangements results from the encoding of the speech information rather than the speech signal itself. The speech information corresponds to the shape of the vocal tract and its excitation and as is well known in the art, its bandwidth is substantially less than the bandwidth of the speech signal. The LPC coding technique partitions a speech pattern into a sequence of time frame intervals 5 to 20 millisecond in duration. The speech signal is quasi-stationary during such time intervals and may be characterized as a relatively simple vocal tract model specified by a small number of parameters. For each time frame, a set of linear predictive parameters are generated which are representative of the spectral content of the speech pattern. Such parameters may be applied to a linear filter which models the human vocal tract along with signals representative of the vocal tract excitation to reconstruct a replica of the speech pattern. A system illustrative of such an arrangement is described in U.S. Pat. No. 3,624,302 issued to B. S. Atal, Nov. 30, 1971, and assigned to the same assignee.

Vocal tract excitation for LPC speech coding and speech synthesis systems may take the form of pitch period signals for voiced speech, noise signals for unvoiced speech and a voiced-unvoiced signal corresponding to the type of speech in each successive LPC frame. While this excitation signal arrangement is sufficient to produce a replica of a speech pattern at relatively low bit rates, the resulting replica has limited quality. A significant improvement in speech quality is obtained by using a predictive residual excitation signal corresponding to the difference between the speech pattern of a frame and a speech pattern produced in response to the LPC parameters of the frame. The predictive residual, however, is noiselike since it corresponds to the unpredicted portion of the speech pattern. Consequently, a very high bit rate is needed for its representation. U.S. Pat. No. 3,631,520 issued to B. S. Atal, Dec. 28, 1971, and assigned to the same assignee discloses a speech coding system utilizing predictive residual excitation.

An arrangement that provides the high quality of predictive residual coding at a relatively low bit rate is disclosed in the copending application Ser. No. 326,371, filed by B. S. Atal et al on Dec. 1, 1981, now U.S. Pat. No. 4,472,382, and assigned to the same assignee and in the article, "A new model of LPC excitation for producing natural sounding speech at low bit rates," appearing in the *Proceedings of the International Conference on Acoustics, Speech and Signal Processing,* Paris, France, 1982, pp. 614–617. As described therein, a signal corresponding to the speech pattern for a frame is generated as well as a signal representative of its LPC parameters responsive speech pattern for the frame. A prescribed format multipulse signal is formed for each successive LPC frame responsive to the differences between the frame speech pattern signal and the frame LPC derived speech pattern signal. Unlike the predictive residual excitation whose bit rate is not controlled, the bit rate of the multipulse excitation signal may be selected to conform to prescribed transmission and storage requirements. In contrast to the predictive vocoder type arrangement, intelligibility and naturalness is improved, partially voiced intervals are accurately encoded and classification of voiced and unvoiced speech intervals is eliminated.

While the aforementioned multipulse excitation provides high quality speech coding at relatively low bit rates, it is desirable to reduce the code bit rate further in order to provide greater economy. In particular, the reduced bit rate coding permits economic storage of vocabularies in speech synthesizers and more economical usage of transmission facilities. In pitch excited vocoders of the type described in aforementioned U.S. Pat. No. 3,624,302, the excitation bit rate is relatively low. Further reduction of total bit rate can be accomplished in voiced segments by repeating the spectral parameter signals from frame to frame since the excitation spectrum is independent of the spectral parameter signal spectrum.

Multipulse excitation utilizes a plurality of different value pulses for each time frame to achieve higher quality speech transmission. The multipulse excitation code corresponds to the predictive residual so that there is a complex interdependence between the predictive parameter spectra and excitation signal spectra. Thus, simple respacing of the multipulse excitation signal adversely affects the intelligibility of the speech pattern. Changes in speaking rate and inflections of a speech pattern may also be achieved by modifying the excitation and spectral parameter signals of the speech pattern frames. This is particularly important in applications where the speech is derived from written text and it is desirable to impart distinctive characteristics to the speech pattern that are different from the recorded coded speech elements.

It is an object of the invention to provide an improved predictive speech coding arrangement that produces high quality speech at a reduced bit rate. It is another object of the invention to provide an improved predictive coding arrangement adapted to modify the characteristics of speech messages.

BRIEF SUMMARY OF THE INVENTION

The foregoing objects may be achieved in a multipulse predictive speech coder in which a speech pattern is divided into successive time frames and spectral parameter and multipulse excitation signals are generated for each frame. The voiced excitation signal intervals of the speech pattern are identified. For each sequence of successive voiced excitation intervals, one interval is selected. The excitation and spectral parameter signals for the remaining voiced intervals in the sequence are replaced by the multipulse excitation signal and the spectral parameter signals of the selected interval. In this way, the number of bits corresponding to the succession of voiced intervals is substantially reduced.

The invention is directed to a predictive speech coding arrangement in which a time frame sequence of speech parameter signals are generated for a speech pattern. Each time frame speech parameter signal includes a set of spectral representative signals and an excitation signal. Prescribed type excitation intervals in the speech pattern are identified and the excitation signals of selected prescribed type intervals are modified.

According to one aspect of the invention, one of a sequence of sucessive prescribed excitation intervals is selected and the excitation signal of the selected prescribed interval is substituted for the excitation signals of the remaining prescribed intervals of the sequence.

According to another aspect of the invention, the speaking rate and/or intonation of the speech pattern are altered by modifying the multipulse excitation signals of the prescribed excitation intervals responsive to a sequence of editing signals.

BRIEF DESCRIPTION OF THE DRAWING

FIG. 2 depicts a block diagram of a speech code modification arrangement illustrative of the invention;

FIGS. 9, 10 and 11 show detailed flow charts illustrating the operation of the circuit of FIG. 2 in modifying the intonation pattern of a speech message;

FIG. 12 shows the arrangement of FIGS. 9, 10, and 11; and

DETAILED DESCRIPTION

Figure 1:
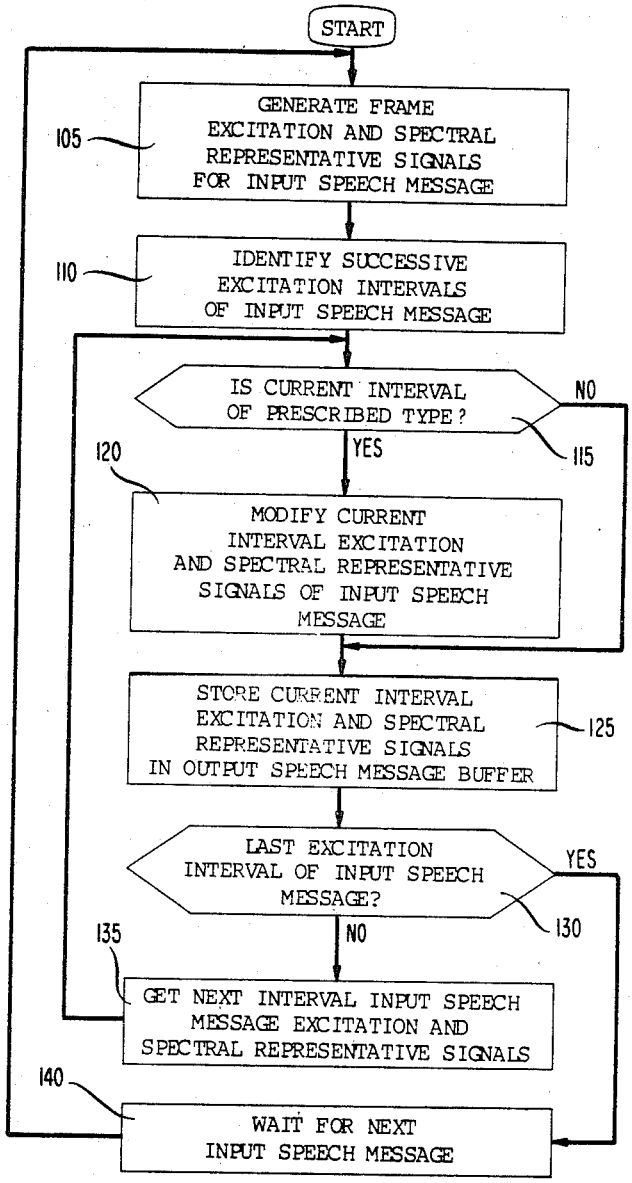
FIG. 1 depicts a general flow chart illustrative of the invention.

FIG. 1 depicts a generalized flow chart showing an arrangement for modifying a spoken message in accordance with the invention and FIG. 2 depicts a circuit for implementing the method of FIG. 1. The arrangement of FIGS. 1 and 2 is adapted to modify a speech message that has been converted into a sequence of linear predictive codes representative of the speech pattern. As described in the article "A new method of LPC excitation for producing natural sounding speech at low bit rates," appearing in the *Proceedings of the International Conference of Acoustics, Speech and Signal Processing,* Paris, France, 1982, pp. 614–617, the speech representative codes are generated sampling a speech message at a predetermined rate and partitioning the speech samples into a sequence of 5 to 20 millisecond duration time frames. In each time frame, a set of spectral representative parameter signals and a multipulse excitation signal are produced from the speech samples therein. The multipulse excitation signal comprises a series of pulses in each time frame occurring at a predetermined bit rate and corresponds to the residual difference between the frame speech pattern and a pattern formed from the linear predictive spectral parameters of the frame.

We have found that the residual representative multipulse excitation signal may be modified to reduce the coding bit requirements, alter the speaking rate of the speech pattern or control the intonation pattern of the speech message. Referring to FIG. 2, an input speech message is generated in speech source 201 and encoded in multipulse predictive form in coded speech encoder 205. The operations of the circuit of FIG. 2 are controlled by a series of program instructions that are permanently stored in control store read only memory (ROM) 245. Read only memory 245 may be the type PROM64k/256k memory board made by Electronic Solutions, San Diego, Calif. Speech source 201 may be a microphone, a data processor adapted to produce a speech message or other apparatus well known in the art. In the flow chart of FIG. 1, multipulse excitation and reflection coefficient representative signals are formed for each successive frame of the coded speech message in generator 205 as per step 105.

The frame sequence of excitation and spectral representative signals for the input speech message are transferred via bus 220 to input message buffer store 225 and are stored in frame sequence order. Buffer stores 225, 233, and 235 may be the type RAM 32c memory board made by Electronic Solutions. Subsequent to the speech pattern code generation, successive intervals of the excitation signal are identified (step 110). This identification is performed in speech message processor 240 under control of instructions from control store 245. Message processor 240 may be the type PM68K single board computer produced by Pacific Microcomputers, Inc., San Diego, Calif. and bus 220 may comprise the type MC-609 MULTIBUS compatible rack mountable chassis made by Electronic Solutions, San Diego, Calif. Each excitation interval is identified as voiced or other than voiced by means of pitch period analysis as described in the article, "Parallel processing techniques for estimating pitch periods of speech in the time domain," by B. Gold and L. R. Rabiner, *Journal of the Acoustical Society of America* 46, pp. 442–448, responsive to the signals in input buffer 225.

For voiced portions of the input speech message, the excitation signal intervals correspond to the pitch periods of the speech pattern. The excitation signal intervals for other portions of the speech pattern correspond to the speech message time frames. An identification code (pp(i)) is provided for each interval which defines the interval location in the pattern and the voicing character of the interval. A frame of representative spectral signals for the interval is also selected.

After the last excitation interval has been processed in step 110, the steps of loop 112 are performed so that the excitation signals of intervals of a prescribed type, e.g., voiced, are modified to alter the speech message codes. Such alteration may be adapted to reduce the code storage and/or transmission rate by selecting an excitation code of the interval and repeating the selected code for other frames of the interval, to alter the speaking rate of the speech message, or to control the intonation pattern of the speech message. Loop 112 is entered through decision step 115. If the interval is of a prescribed type, e.g., voiced, the interval excitation and spectral representative signals are placed in interval store 233 and altered as per step 120. The altered signals are transferred to output speech message store 235 in FIG. 2 as per step 125.

If the interval is not of the prescribed type, step 125 is entered directly from step 115 and the current interval excitation and spectral representative signals of the input speech message are transferred from interval buffer 233 to output speech message buffer 235 without change. A determination is then made as to whether the current excitation interval is the last interval of the speech message in decision step 130. Until the last interval is processed, the immediately succeeding excitation signal interval signals are addressed in store 135 as per step 135 and step 115 is reentered to process the next interval. After the last input speech message interval is processed, the circuit of FIG. 2 is placed in a wait state as per step 140 until another speech message is received by coded speech message generator 205.

Figures 3, 5:
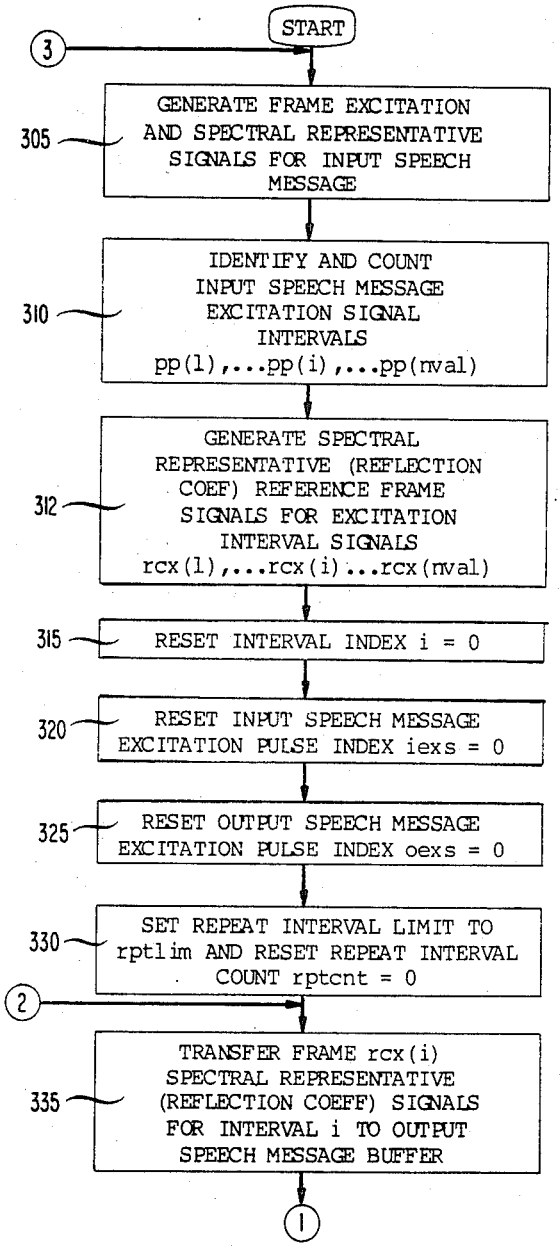
FIGS. 3 and 4 show detailed flow charts illustrating the operation of the circuit of FIG. 2 in reducing the excitation code bit rate.
FIG. 5 shows the arrangement of FIGS. 3 and 4.
Figure 4:
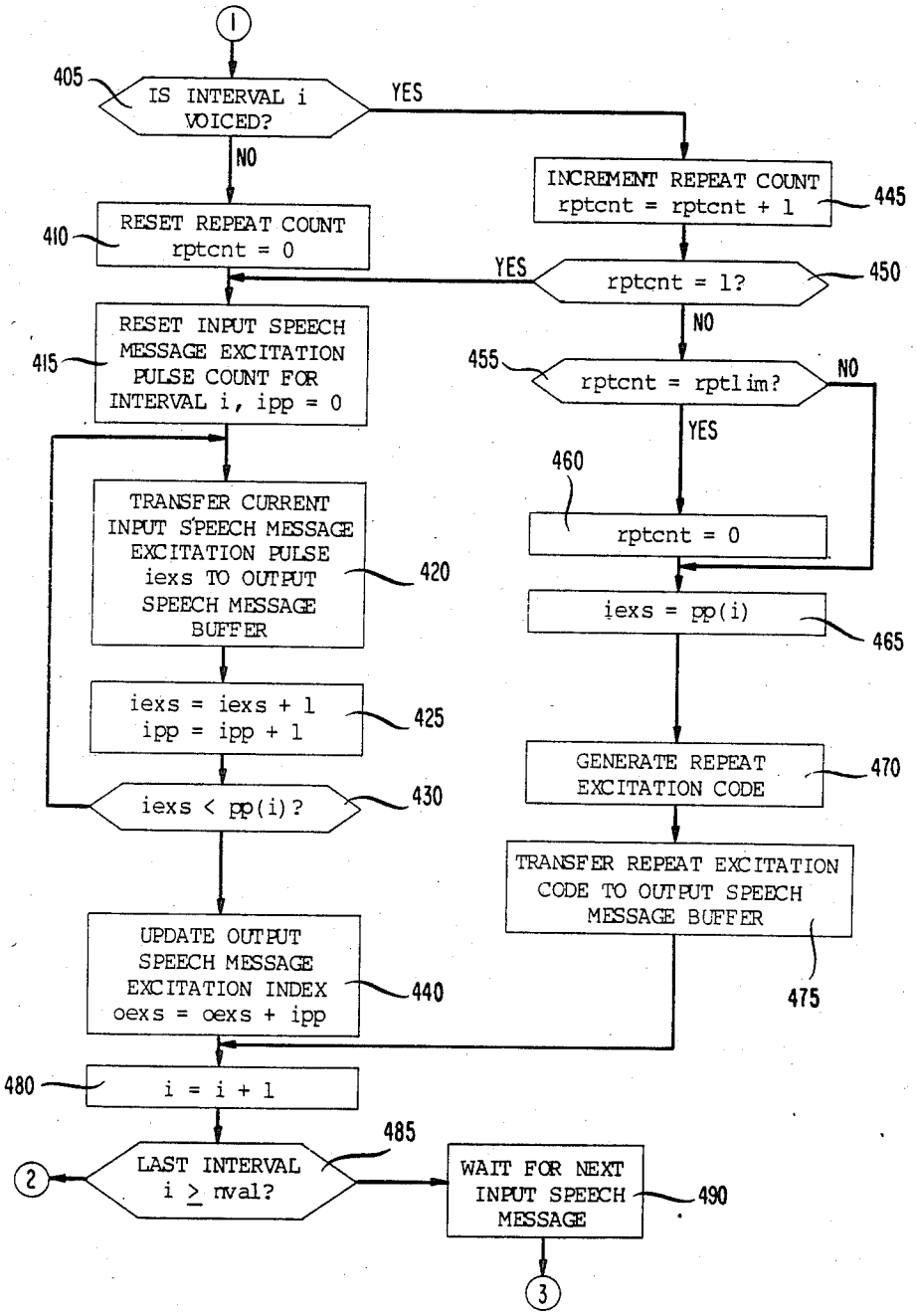
Figure 13:
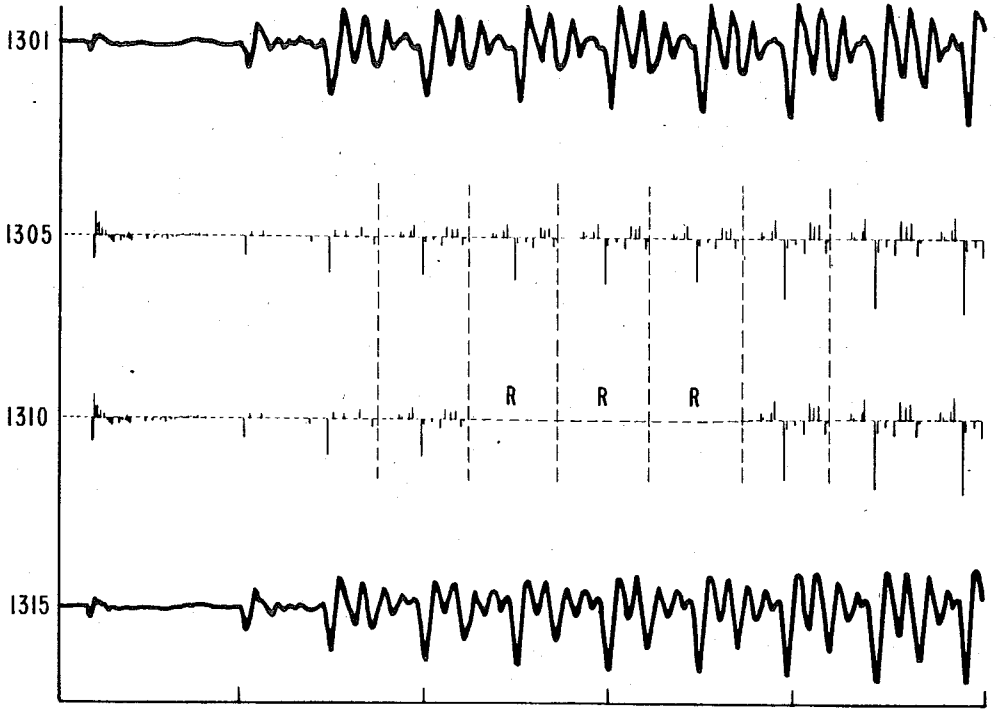
FIGS. 13–14 show waveforms illustrative of the operation of the flow charts in FIGS. 3 through 12.

The flow charts of FIGS. 3 and 4 illustrate the operations of the circuit of FIG. 2 in compressing the excitation signal codes of the input speech message. For the compression operations, control store 245 contains a set of program instructions adapted to carry out the flow charts of FIGS. 3 and 4. The program instruction set is set forth in Appendix A attached hereto in C language form well known in the art. The code compression is obtained by detecting voiced intervals in the input speech message excitation signal, selecting one, e.g., the first, of a sequence of voiced intervals and utilizing the excitation signal code of the selected interval for the succeeding intervals of the sequence. Such succeeding interval excitation signals are identified by repeat codes. FIG. 13 shows waveforms illustrating the method. Waveform 1301 depicts a typical speech message. Waveform 1305 shows the multipulse excitation signals for a succession of voiced intervals in the speech message of waveform 1301. Waveform 1310 illustrates coding of the output speech message with the repeat codes for the intervals succeeding the first voiced interval and waveform 1315 shows the output speech message obtained from the coded signals of waveform 1310. In the following illustrative example, each interval is identified by a signal pp(i) which corresponds to the location of the last excitation pulse position of the interval. The number of excitation signal pulse positions in each input speech message interval i is ipp, the index of pulse positions of the input speech message excitation signal codes is iexs and the index of the pulse positions of the output speech message excitation signal is oexs.

Referring to FIGS. 2 and 3, frame excitation and spectral representative signals for an input speech message from source 201 in FIG. 2 are generated in speech message encoder 205 and are stored in input speech message buffer 225 as per step 305. The excitation signal for each frame comprises a sequence of excitation pulses corresponding to the predictive residual of the frame, as disclosed in the copending application Ser. No. 326,371, filed by B. S. Atal et al on Dec. 1, 1981 and assigned to the assignee hereof (now U.S. Pat. No. 4,472,382) and incorporated by reference herein. Each excitation pulse is of the form $\beta$, m where $\beta$ represents the excitation pulse value and m represents the excitation pulse position in the frame. $\beta$ may be positive, negative or zero. The spectral representative signals may be reflection coefficient signals or other linear predictive signals well known in the art.

In step 310, the sequence of frame excitation signals in input speech message buffer 225 are processed in speech message processor 240 under control of program store 245 so that successive intervals are identified and each interval i is classified as voiced or other than voiced. This is done by pitch period analysis.

Each nonvoiced interval in the speech message corresponds to a single time frame representative of a portion of a fricative or other sound that is not clearly a voiced sound. A voiced interval in the speech message corresponds to a series of frames that constitute a pitch period. In accordance with an aspect of the invention, the excitation signal of one of a sequence of voiced intervals is utilized as the excitation signal of the remaining intervals of the sequence. The identified interval signal pp(i) is stored in buffer 225 along with a signal nval representative of the last excitation signal interval in the input speech message.

After the identification of speech message excitation signal intervals, the circuit of FIG. 2 is reset to its initial state for formation of the output speech message. As shown in FIG. 3 in steps 315, 320, 325, and 330, the interval index i is set to zero to address the signals of the first interval in buffer 225. The input speech message excitation pulse index iexs corresponding to the current excitation pulse location in the input speech message and the output speech message excitation pulse index oexs corresponding to the current location in the output speech message are reset to zero and the repeat interval limit signal rptlim corresponding to the number of voiced intervals to be represented by a selected voiced interval excitation code is initially set. Typically, rptlim may be preset to a constant in the range from 2 to 15. This corresponds to a significant reduction in excitation signal codes for the speech message but does not affect its quality.

The spectral representative signals of frame rcx(i) of the current interval i are addressed in input speech message buffer 225 (step 335) and are transferred to the output buffer 235. Decision step 405 in FIG. 4 is then entered and the interval voicing identification signal is tested. If interval i was previously identified as not voiced, the interval is a single frame and the repeat count signal rptcnt is set to zero (step 410) and the input speech message excitation count signal ipp is reset to zero (step 415). The currently addressed excitation pulse having location index iexs, of the input speech message is transferred from input speech message buffer 225 to output speech message buffer 235 (step 420) and the input speech message excitation pulse index iexs as well as the excitation pulse count ipp of current interval i are incremented (step 425).

Signal pp(i) corresponds to the location of the last excitation pulse of interval i. Until the last excitation pulse of the interval is accessed, step 420 is reentered via decision step 430 to transfer the next interval excitation pulse. After the last interval i pulse is transferred, the output speech message location index oexs is incremented by the number of excitation pulses in the interval ipp (step 440).

Since the interval is not of the prescribed voice type, the operations in steps 415, 420, 425, 430, 435, and 440 result in a direct transfer of the interval excitation pulses without alteration of the interval excitation signal. The interval index i is then incremented (step 480) and the next interval is processed by reentering step 335 in FIG. 3.

Assume for purposes of illustration that the current interval is the first of a sequence of voiced intervals. (Each interval corresponds to a pitch period.) Step 445 is entered via decision step 405 in FIG. 4 and the repeat interval count rptcnt is incremented to one. Step 415 is then entered via decision step 450 and the current interval excitation pulses are transferred to the output speech message buffer without modification as previously described.

Where the next group of intervals are voiced, the repeat count rptcnt is incremented to greater than one in the processing of the second and successive voiced intervals in step 445 so that step 455 is entered via step 450. Until the repeat count rptcnt equals the repeat limit signal rptlim, steps 465, 470, and 475 are performed. In step 465, the input speech message location index is incremented to pp(i) which is the end of the current interval. The repeat excitation code is generated (step 470) and a repeat excitation signal code is transferred to output speech message buffer (step 475). The next interval processing is then initiated via steps 480 and 335.

The repeat count signal is incremented in step 445 for successive voiced intervals. As long as the repeat count signal is less than or equal to the repeat limit, repeat excitation signal codes are generated and transferred to buffer 235 as per steps 465, 470 and 475. When signal rptcnt equals signal rptlim in step 455, the repeat count signal is reset to zero in step 460 so that the next interval excitation signal pulse sequence is transferred to buffer 235 rather than the repeat excitation signal code. In this way, the excitation signal codes of the input speech message are modified to that the excitation signal of one of a succession of voiced intervals is repeated to achieve speech signal code compression. The compression arrangement of FIGS. 3 and 4 alter both the excitation signal and the reflection coefficient signals of such repeated voiced interval. When it is desirable, the original reflection coefficient signals of the interval frames may be transferred to the output speech message buffer while only the excitation signal is repeated.

After the last excitation interval of the input speech pattern is processed in the circuit of FIG. 2, step 490 is entered via step 485. The circuit of FIG. 2 is then placed in a wait state until an ST signal is received from speech coder 205 indicating that a new input speech signal has been received from speech source 201.

Figure 6:
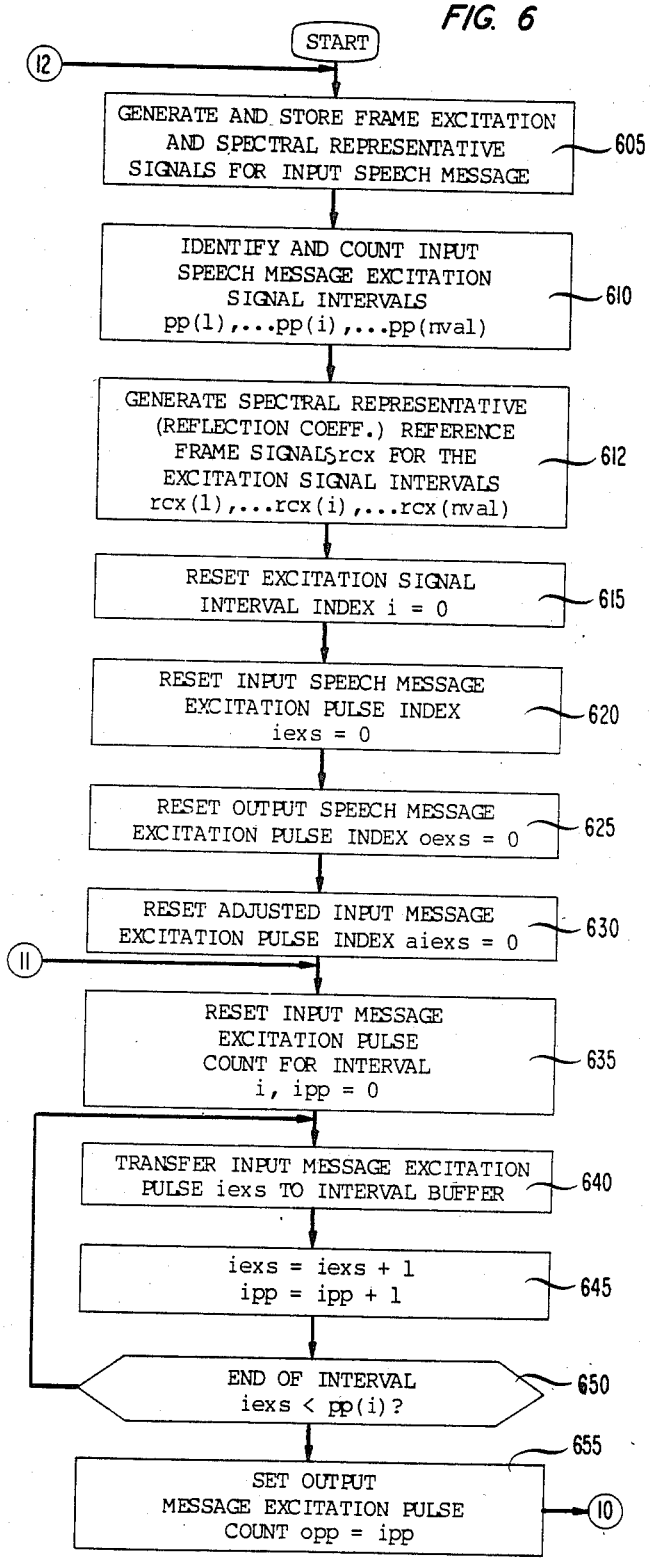
FIGS. 6 and 7 show detailed flow charts illustrating the operation of the circuit of FIG. 2 in changing the speaking rate characteristic of a speech message.
Figures 7, 8:
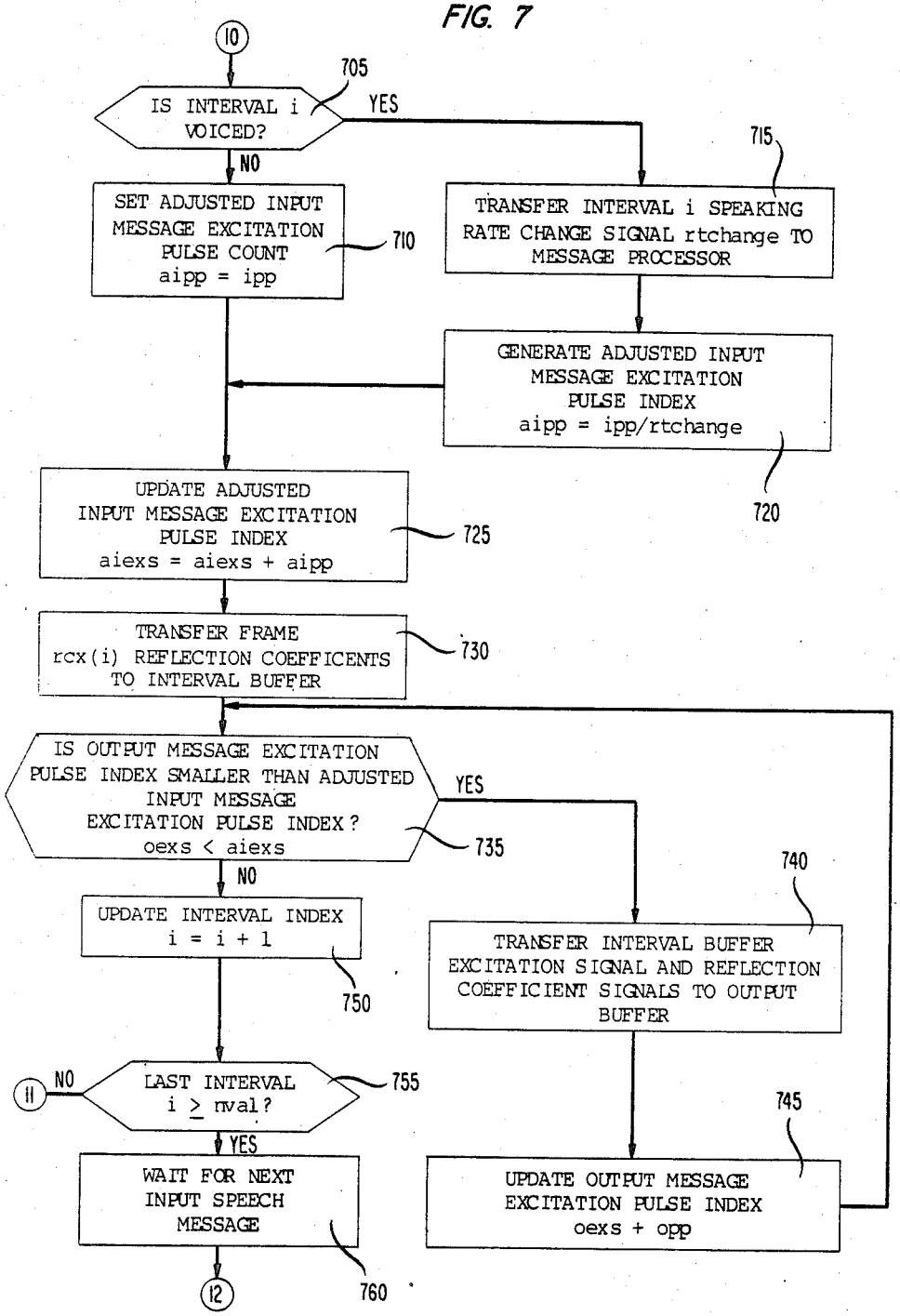
FIG. 8 shows the arrangement of FIGS. 6 and 7.
Figure 14:
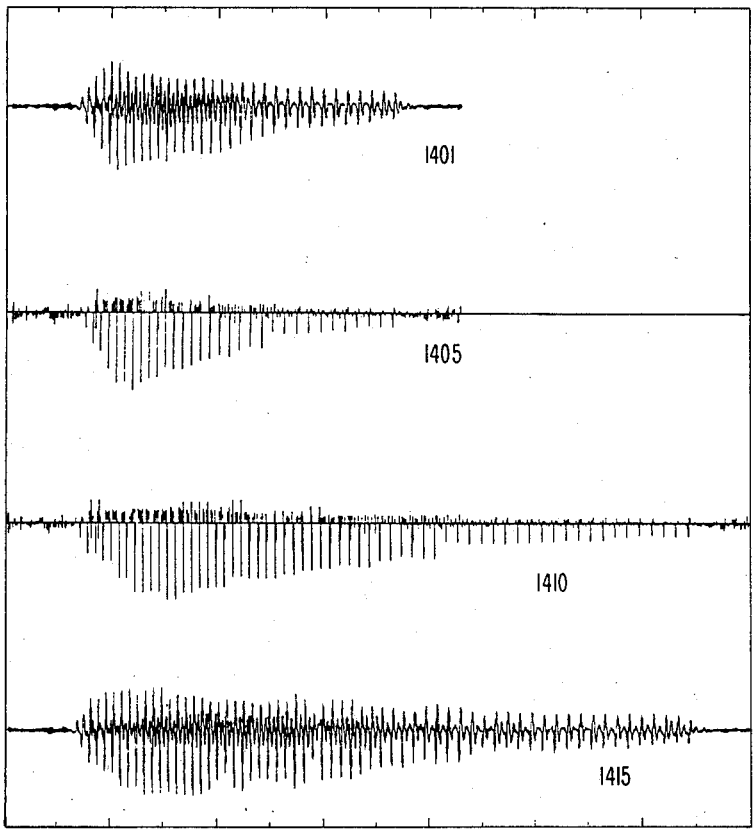

The flow charts of FIGS. 6 and 7 illustrate the operation of the circuit of FIG. 2 in changing the speaking rate of an input speech message by altering the speaking rate of the voiced portions of the message. For the speaking rate operations, control store 245 contains a set of program instructions adapted to carry out the flow charts of FIGS. 6 and 7. This program instruction set is set forth in Appendix B attached hereto in C language form well known in the art. The alteration of speaking rate is obtained by detecting voiced intervals, and modifying the duration and/or number of excitation signal intervals in the voiced portion. Where the interval durations in a voiced portion of the speech message are increased, the speaking rate of the speech pattern is lowered and where the interval durations are decreased, the speaking rate is raised. FIG. 14 shows waveforms illustrating the speaking rate alteration method. Waveform 1401 shows a speech message portion at normal speaking rate and waveform 1405 shows the excitation signal sequence of the speech message. In order to reduce the speaking rate of the voiced portions, the number of intervals must be increased. Waveform 1410 shows the excitation signal sequence of same speech message portion as in waveform 1405 but with the excitation interval pattern having twice the number of excitation signal intervals so that the speaking rate is halved. Waveform 1415 illustrates an output speech message produced from the modified excitation signal pattern of waveform 1410.

With respect to the flow charts of FIGS. 6 and 7, each multipulse excitation signal interval has a predetermined number of pulse positions m and each pulse position has a value $\beta$ that may be positive, zero, or negative. The pulse positions of the input message are indexed by a signal iexs and the pulse positions of the output speech message are indexed by a signal oexs. Within each interval, the pulse positions of the input message are indicated by count signal ipp and the pulse positions of the output message are indicated by count opp. The intervals are marked by interval index signal pp(i) which corresponds to the last pulse position of the input message interval. The output speech rate is determined by the speaking rate change signal rtchange stored in modify message instruction store 230.

Referring to FIG. 6, the input speech message from source 201 in FIG. 2 is processed in speech encoder 205 to generate the sequence of frame multipulse and spectral representative signals and these signals are stored in input speech message buffer 225 as per step 605. Excitation signal intervals are identified as pp(1), . . . pp(i), . . . pp(nvval) in step 610. Step 612 is then performed so that a set of spectral representative signals, e.g., reflection coefficient signals for one frame rcx(i) in each interval is identified for use in the corresponding intervals of the output speech message. The selection of the reflection coefficient signal frame is accomplished by aligning the excitation signal intervals so that the largest magnitude excitation pulse is located at the interval center. The interval i frame in which the largest magnitude excitation pulse occurs is selected as the reference frame rcx(i) for the reflection coefficient signals of the interval i. In this way, the set of reflection coefficient frame indices rcx(i), . . . rcx(i), . . . rcx(nval)are generated and stored.

The circuit of FIG. 2 is initialized for the speech message speaking rate alteration in steps 615, 620, 625, and 630 so that the interval index i, the input speech message excitation pulse indices iexs and oexs, and the adjusted input speech message excitation pulse index are reset to zero. At the beginning of the speech message processing of each interval i, the input speech message excitation pulse index for the current interval i is reset to zero in step 635. The succession of input speech message excitation pulses for the interval are transferred from input speech message buffer to interval buffer 233 through the operations of steps 640, 645 and 650. Excitation pulse index signal iexs is transferred to the interval buffer in step 640. The iexs index signal and the interval input pulse count signal ipp are incremented in step 645 and a test is made for the last interval pulse in decision step 650. The output speech message excitation pulse count for the current interval opp is then set equal to the input speech message excitation pulse count in step 655.

At this point in the operation of the circuit of FIG. 2, interval buffer 233 contains the current interval excitation pulse sequence, the input speech message excitation pulse index iexs is set to the end of the current interval pp(i), and the speaking rate change signal is stored in the modify message instruction store 230. Step 705 of the flow chart of FIG. 7 is entered to determine whether the current interval has been identified as voiced. In the event the current interval i is not voiced, the adjusted input message excitation pulse count for the frame aipp is set to the previously generated input pulse count since no change in the speech message is made. Where the current interval i is identified as voiced, the path through steps 715 and 720 is traversed.

In step 715, the interval speaking rate change signal rtchange is sent to message processor 240 from message instruction store 230. The adjusted input message excitation pulse count for the interval aipp is then set to ipp/rtchange. For a halving of the speaking rate (rtchange$=\frac{1}{2}$), the adjusted count is made twice the input speech message interval count ipp. The adjusted input speech message excitation pulse index is incremented in step 725 by the count aipp so that the end of the new speaking rate message is set. For intervals not identified as voiced, the adjusted input message index is the same as the input message index since there is no change to the interval excitation signal. For voiced intervals, however, the adjusted index reflects the end point of the intervals in the output speech message corresponding to interval i of the input speech message.

The representative reflection coefficient set for the interval (frame rcx(i)) are transferred from input speech message buffer 225 to interval buffer 233 in step 730 and the output speech message is formed in the loop including steps 735, 740 and 745. For other than voiced intervals, there is a direct transfer of the current interval excitation pulses and the representative reflection coefficient set. Step 735 tests the current output message excitation pulse index to determine whether it is less than the current input message excitation pulse index. Index oexs for the unvoiced interval is set at pp(i−1) and the adjusted input message excitation pulse index aiexs is set at pp(i). Consequently, the current interval excitation pulses and the corresponding reflection coefficient signals are transferred to the output message buffer in step 740. After the output excitation pulse index is updated in step 745, oexs is equal to aiexs. Step 750 is entered and the interval index is set to the next interval. Thus there are no intervals added to the speech message for a non-voiced excitation signal interval.

In the event the current interval is voiced, the adjusted input message excitation index aiex differs from the input message excitation pulse index iexs and the loop including steps 735, 740 and 750 may be traversed more than once. Thus there may be two or more input message interval excitation and reflection coefficient signal sets put into the output message. In this way, the speaking rate is changed. The processing of input speech message intervals is continued by entering step 635 via decision step 755 until the last interval nval has been processed. Step 760 is then entered from step 755 and the circuit of FIG. 2 is placed in a wait state until another speech message is detected in speech encoder 205.

Figures 9, 12:
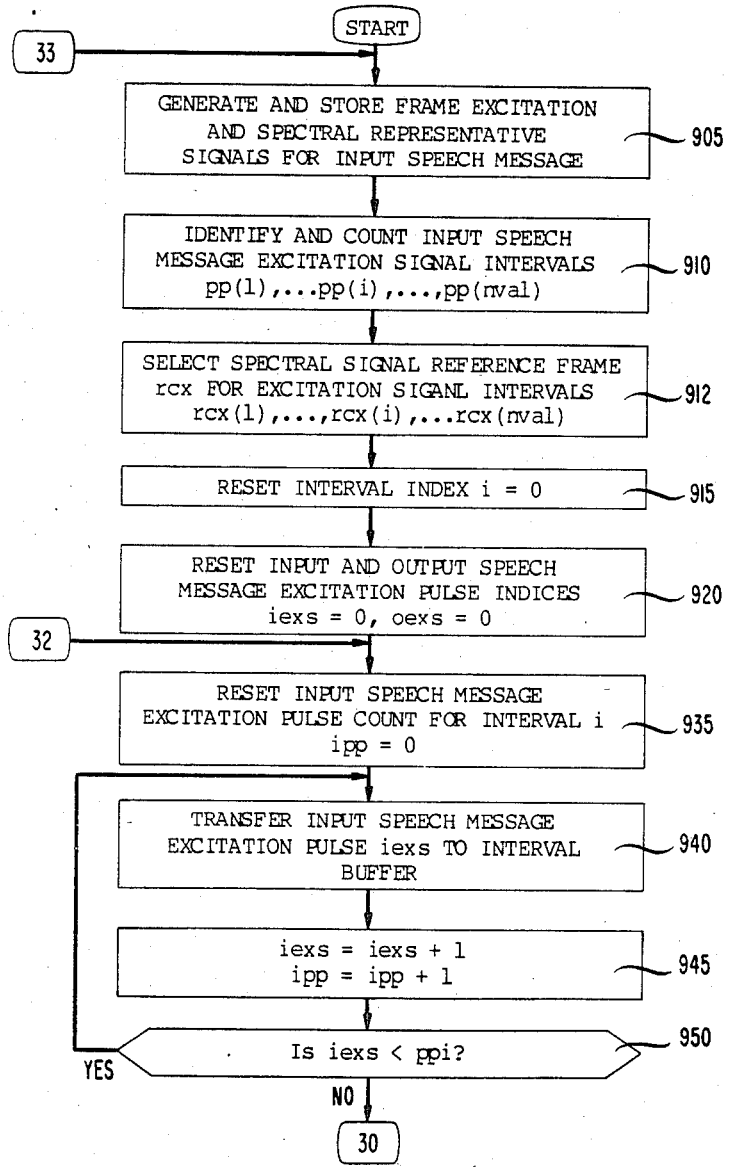
Figure 10:
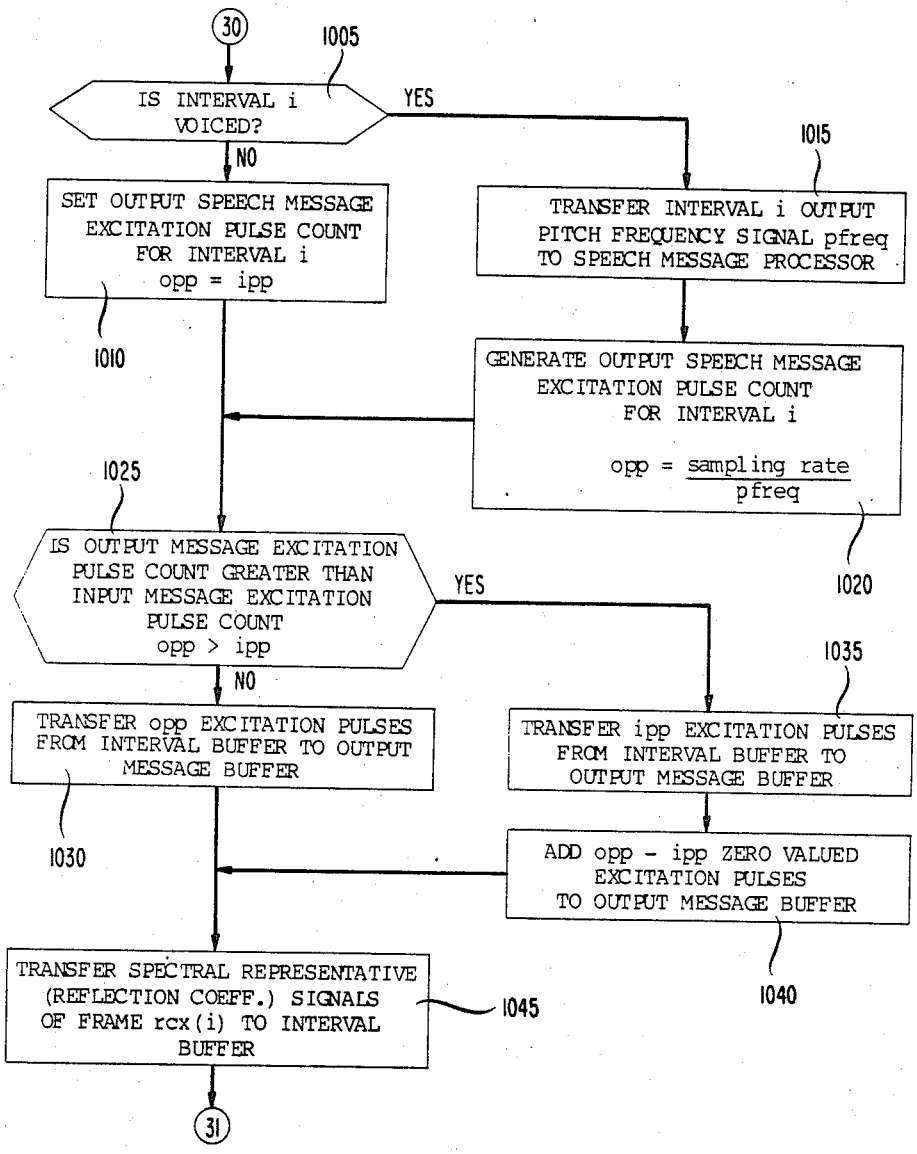

The flow charts of FIGS. 9–11 illustrate the operation of the circuit of FIG. 2 in altering the intonation pattern of a speech message according to the invention. Such intonation change may be accomplished by modifying the pitch of voiced portions of the speech message in accordance with a prescribed sequence of editing signals, and is particularly useful in imparting appropriate intonation to machine generated artificial speech messages. For the intonation changing arrangement, control store 245 contains a set of program instructions adapted to carry out the flow charts of FIGS. 9–11. The program instruction set is set forth in Appendix C attached hereto in C language form well known in the art.

In the circuit of FIG. 2, the intonation pattern editing signals for a particular input speech message is stored in modify message instruction store 230. The stored pattern comprises a sequence of pitch frequency signals pfreq that are adated to control the pitch pattern of sequences of voiced speech intervals as described in the article, "Synthesizing intonation," by Janet Pierrehumbert, appearing in the *Journal of the Acoustical Society of America,* 70(4), October, 1981, pp. 985–995.

Referring to FIGS. 2 and 9, a frame sequence of excitation and spectral representative signals for the input speech pattern is generated in speech encoder 205 and stored in input speech message buffer 225 as per step 905. The speech message excitation signal intervals are identified by signals pp(i) in step 910 and the spectral parameter signals of a frame rcx(i) of each interval is selected in step 912. The interval index i and the input and output speech message excitation pulse indices iexs and oexs are reset to zero as per steps 915 and 920.

At this time, the processing of the first input speech message interval is started by resetting the interval input message excitation pulse count ipp (step 935) and transferring the current interval excitation pulses to interval buffer 233, incrementing the input message index iexs and the interval excitation pulse count ipp as per iterated steps 940, 945, and 950. After the last excitation pulse of the interval is placed in the interval buffer, the voicing of the interval is tested in message processor 240 as per step 1005 of FIG. 10. If the current interval is not voiced, the output message excitation pulse count is set equal to the input message pulse count ipp (step 1010). For a voiced interval steps 1015 and 1020 are performed in which the pitch frequency signal pfreq(i) assigned to the current interval i is transferred to message processor 240 and the output excitation pulse count for the interval is set to the excitation sampling rate/pfreq(i).

The output message excitation pulse count opp is compared to the input message excitation pulse count in step 1025. If opp is less than ipp, the interval excitation pulse sequence is truncated by transferring only opp excitation pulse positions to the output speech message buffer (step 1030). If opp is equal to ipp, the ipp excitation pulse positions are transferred to the output buffer in step 1030. Otherwise, ipp pulses are transferred to the output speech message buffer (step 1035) and an additional opp-ipp zero valued excitation pulses are sent to the output message buffer (step 1040). In this way, the input speech message interval size is modified in accordance with the intonation change specified by signal pfreq.

After the transfer of the modified interval i excitation pulse sequence to the output speech buffer, the reflection coefficient signals selected for the interval in step 912 are placed in interval buffer 233. The current value of the output message excitation pulse index oexs is then compared to the input message excitation pulse index iexs in decision step 1105 of FIG. 11. As long as oexs if less than iexs, a set of the interval excitation pulses and the corresponding reflection coefficients are sent to the output speech message buffer 235 so that the current interval i of the output speech message receives the appropriate number of excitation and spectral representative signals. One or more sets of excitation pulses and spectral signals may be transferred to the output speech buffer in steps 1110 and 1115 until the output message index oexs catches up to the input message index iexs.

When the output message excitation pulse index is equal to or greater than the input message excitation pulse index, the intonation processing for interval i is complete and the interval index is incremented in step 1120. Until the last interval nval has been processed in the circuit of FIG. 2, step 935 is reentered via decision step 1125. After the final interval has been modified, step 1130 is entered from step 1025 and the circuit of FIG. 2 is placed in a wait state until a new input speech message is detected in speech encoder 205.

The output speech message in buffer 235 with the intonation pattern prescribed by the signals stored in modify message instruction store 233 is supplied to utilization device 255 via I/O circuit 250. The utilization device may be a speech synthesizer adapted to convert the multipulse excitation and spectral representative signal sequence from buffer 235 into a spoken message, a read only memory adapted to be installed in a remote speech synthesizer, a transmission network adapted to carry digitally coded speech messages or other device known in the speech processing art.

The invention has been described with reference to embodiments illustrative thereof. It is to be understood, however, that various changes and modifications may be made by those skilled in the art without departing from the spirit and scope of the invention.

APPENDIX A

```
/* repetition */

#include <stdio.h>

#define SRATE8000        /* sampling rate in Hz */
#define NRPT     2       /* maximum number of repeat intervals */
#define PFMIN    16      /* 16 Hz, lowest pitch freq. permitted */
#define MSAMPL   500     /* number of samples, equivalent
                          * to 16 Hz */
#define NCF      16      /* number of reflection coef. per
                          * analysis frame */
#define RCFRAME 40       /* number of samples in analysis frame */
#define MVAL     1000    /* maximum number of excitation
                          * intervals permitted */
#define VOICED     1
#define UNVOICED 0

int ipp, iexs, oexs, i, rptlim=NRPT, rptcnt, rptflg, nval ;

  /* MLPP = memory location of pp */
  /* MLRC = memory location of trcoef */
  /* MLIMS = memory location of imsbuff */

int *pp=MLPP, rcx[MVAL];
float *trcoef=MLRC;
short imsbuff=MLIMS, omsbuff[MSAMPL];
float rcoef[NCF];
char vuflag[MVAL];


main()
{
/*    get voiced/unvoiced flag for each excitation interval
 *    into pp, vuflag is number of intervals */
          align( pp, vuflag, nval);

/*----generate refl. coeff. frame numbers, store in array
 *    rcx */
          getrcx( nval, pp, rcx);

/*----set up loop over all intervals */
            /*----i    - interval index */
            /*----iexs - index for excitation input samples */
            /*----oexs - index for excitation output samples */
                 /*----rptcnt - repeat count (ranges from 0 to
                  *    rptlim-1 */
          for(i=0, iexs=0, oexs=0, rptcnt=0; i<nval; i++){

            /*----get reflection coeff. for interval i */
          readrc( rcoef, rcx[i]);

            /*----check if interval is voiced */
          if( vuflag[i] == VOICED )
```

```
        /*----yes: increment repeat count */
      ++rptcnt;
      else
        /*----no:  reset repeat count */
      rptcnt=0;

     /*----if repeat count greater 1, reuse previous
      *    excitation */
      if(rptcnt > 1){
        /*----greater:
         *    check if less than repeat limit,
         *    otherwise reset repeat count */
      if(rptcnt == rptlim)
      rptcnt = 0;
        /*----update input sample index */
      iexs = pp[i];
        /*----set repeat flag */
      rptflg = 1;
      }
      else{
        /*----less or equal 1
         *    read input samples for interval i,
         *    copy to output message buffer */
      ipp = readex(iexs, imsbuff, pp[i]);
      iexs += ipp;
      copys( imsbuff, omsbuff, ipp);
      oexs += ipp;
        /*----turn off repeat flag */
      rptflg = 0;
      }
        /*----save refl. coef. and repeat flag or
         *         refl. coef. and excitation for current
         *         portion of output message */
      if(rptflg == 1)
      savrpt( rptflg, rcoef);
      else
      savex( omsbuff, rcoef, ipp);
      }
  /*----end of loop over all intervals  */
}
```

APPENDIX B

```
/* speaking rate change */

#include <stdio.h>

#define SRATE   8000  /* sampling rate in Hz */
#define PFMIN   16    /* 16 Hz, lowest pitch freq. permitted */
#define MSAMPL 500    /* number of samples, equivalent to
                       * 16 Hz */
#define NCF     16    /* number of reflection coef. per
                       * analysis frame */
#define RCFRAME 40    /* number of samples in analysis frame */
#define MVAL    1000  /* maximum number of excitation
                       * intervals permitted */
#define VOICED  1
#define UNVOICED 0
```

```
int ipp, aipp, opp, iexs, aiexs, oexs, i, nval ;
float rtchange, rdrate();

  /* MLPP = memory location of pp */
  /* MLRC = memory location of trcoef */
  /* MLIMS = memory location of imsbuff */
  /*MLSPR  = memory location for speaking rate change data */

int *pp=MLPP, rcx[MVAL];
float *trcoef=MLRC;
short imsbuff=MLIMS, omsbuff[MSAMPL];
float rcoef[NCF];
char vuflag[MVAL];

main(,argv)
{
/*    get voiced/unvoiced flag for each excitation interval
 *    into pp, vuflag is number of intervals */
         align( pp, vuflag, nval);

/*----generate refl. coeff. frame numbers, store in array rcx */
      getrcx( nval, pp, rcx);

/*----set up loop over all intervals */
                    /*----i    - interval index */
                    /*----iexs - index for excitation input
                     *    samples */
                    /*----aiexs - adjusted input sample index */
                    /*----oexs - index for excitation output
                     *    samples */
         for(i=0, iexs=0, aiexs=0, oexs=0;  i<nval;  i++){

            ipp = pp[i]
                 iexs += pp[i];
           /*----determine adjusted input sample count for
            *    interval i */
                 if( vuflag[i] == VOICED ){
                   /*----voiced: read speaking rate change
                    *    ( in percent ) */
                         rtchange = rdrate( iexs - ipp);
                   /*----compute adjusted input sample count */
                         aipp = (float)ipp / rtchange ;
                 }
                 else{
                  /*----unvoiced: adjusted input sample count
                   *    same as input count */
                         aipp = ipp;
                 }

       /*----set output sample count equal input sample count */
             opp = ipp;

       /*----transfer opp samples to output message buffer */
                    copys (imsbuff, omsbuff, opp);

       /*----read reflection coeff. for interval i */
             readrc( rcoef, rcx[i]);

       /*----is output sample index less than adjusted input
        *    sample index?
```

```
          *    if yes, use current data for output message
          *    as long as output sample index less than adj.input
          *    sample index */
               while( oexs < aiexs){
                       savex( omsbuff, rcoef, opp);
                 /*----update output sample count */
                       oexs += opp;
               }

          }
     /*----end of loop over all intervals */
   }
```

APPENDIX C

```
                    /* intonation change */

#include <stdio.h>

#define SRATE   8000 /* sampling rate in Hz */
#define PFMIN   16   /* 16 Hz, lowest pitch freq. permitted */
#define MSAMPL  500  /* number of samples, equivalent to 16 Hz */
#define NCF     16   /* number of reflection coef. per
                      * analysis frame */
#define RCFRAME 40   /* number of samples in analysis frame */
#define MVAL    1000 /*maximum number of excitation
                      * intervals permitted */
#define VOICED  1
#define UNVOICED 0

int ipp, opp, iexs, oexs, i, pfreq, nval ;

  /* MLPP = memory location of pp */
  /* MLRC = memory location of trcoef */
  /* MLIMS = memory location of imsbuff */
  /* MLNP  = memory location of modified intonation data */

int *pp=MLPP, rcx[MVAL];
float *trcoef=MLRC;
short imsbuff=MLIMS, omsbuff[MSAMPL];
int newpf=MLNP;
float rcoef[NCF];
char vuflag[MVAL];

main()
{

/*    get voiced/unvoiced flag for each excitation interval
 *    into pp, vuflag is number of intervals */
         align( pp, vuflag, nval);

/*----generate refl. coeff. frame numbers, store in array rcx */
      getrcx( nval, pp, rcx);

/*----set up loop over all intervals */
                    /*----i    - interval index */
                    /*----iexs - index for excitation input
                     *    samples */
                    /*----oexs - index for excitation output
                     *    samples */
          for(i=0, iexs=0, oexs=0; i<nval; i++){
```

```
            ipp = pp[i];
                iexs += ipp;

          /*----determine output sample count for interval i */
                if( vuflag[i] == VOICED ){
                  /*----voiced: read new pitch frequency */
                        pfreq = readpf( iexs - ipp);
                  /*----compute output sample count from pitch
                   *    frequency */
                        opp = SRATE/pfreq;
                }
                else{
                  /*----unvoiced: output sample count same as
                   *    input count */
                        opp = ipp;
                }
          /*----is output sample count greater than input
           *    sample count? */
                if( opp > ipp){
                  /*----yes: transfer all input samples to
                   *    output message buffer */
                        copys( imsbuff, omsbuff, ipp);
                  /*----add zero valued samples to fill
                   *    buffer to opp samples */
                        zeros( omsbuff+ipp, opp-ipp);
                }
                else{
                  /*----no: transfer only opp samples to
                   *    output message buffer */
                        copys (imsbuff, omsbuff, opp);
                }
          /*----get reflection coeff. for interval i */
                readrc( rcoef, rcx[i]);

          /*----is output sample index less than input
           *    sample index?
           *    if yes, use current data for output message
           *    as long as output sample index less than input
           *    sample index */
                while( oexs < iexs){
                        savex( omsbuff, rcoef, opp);
                  /*----update output sample count */
                        oexs += opp;
                }
        }
    /*----end of loop over all intervals */
}
/*----function to align voiced interval boundaries
 *    intervals if found and the boundary centered between
 *    those two locations */
align( pp, vuflag, nval)
int *pp, *vuflag;
int nval;
{          int j, iexs, prevpk = -1, currpk, ipp;
          /*----loop over all intervals */
                for( j=0, iexs=0; j<nval ; ++j){
          ipp = pp[j];
            /*----if interval is unvoiced do nothing */
          if( vuflag[j] == UNVOICED) {
          prevpk = -1;
          iexs += ipp;
```

```
                continue;
                }
               /*----if interval is voiced, find location of largest
                *     sample */
                currpk = iexs + peakloc( imsbuff, ipp);
               /*----check if this is not the first voiced
                *     interval */
                if( prevpk != -1)
                  /*----not first: perform alignment */
                pp[j-1] = prevpk + (currpk - prevpk)/2 ;
                prevpk = currpk;
                iexs += ipp;
                }
    }
    /*----function to copy n samples from one buffer to another */
    copys(in, out, n)
    short *in, *out;
    int n;
    {           for( ; n>0; --n)
                *out++ = *in++;
    }
    /*----function to compute indexes to reflect. coeff. frame
     *     at center of each interval */
    getrcx(nval, pp, rcx)
    int nval, *pp, *rcx;
    {           int prevpp, half;
                for( prevpp=0; nval>0; --nval){
                half = (*pp - prevpp)/2;
                *rcx++ + (prevpp + half)/RCFRAME;
                prevpp = *pp++;
                }
    }
    /*----function to find the location of the largest sample
     *     in the buffer */
    peakloc(buff,n)
    short *buff;
    int n;
    {           int loc, max, temp, j;
                for( j=0, loc=0, max=0; j<n; ++j){
                  /*----get absolute value of current sample */
                temp = (*buff > 0) ? *buff++ : ( - *buff++);
                if( max < temp){
               loc = j;
               max = temp;
               }
               }
               return( loc);
    }
    /*----function to read new speaking rate at sample number n */
    float rdrate(n)
    int n;
    {
      /* note: only a few speak.rate values are specified over the
       *       whole message, inbetween values are obtained by
       *       linear interpolation.
       *       a new rate expressed as .5 means half the original
       *       speaking rate
            int sdiff;
            static struct sprct *psprc=sprc;
            float rdiff, deltarate;
            static int s1=0, s2=0;
            static float r1=1., r2=1.;
            while( n >= s2 ){
```

```
                s1 = s2;
                r1 = r2;
                s2 = psprc -> sp_i;
                r2 = (psprc++) -> sp_u;
                rdiff = r2 - r1;
                sdiff = s2 - s1;
        }
        deltarate = ((n - s1) * rdiff)/ sdiff;
        return( r1 + deltarate);
}

/*----function to read new pitch frequency at sample number n */
readpf(n)
int n;
{
  /* note: only a few frequency values are specified over the
   *       whole message, inbetween values are obtained by
   *       linear interpolation
   * input format: <input sample index>  <pitch frequency value
                    at this point> */
        int sdiff, fdiff, deltafrq;
        static int s1=0, s2=0;
        static int *pnewpf=newpf;
        static int f1, f2;
        while( n >= s2 ){
                s1 = s2;
                f1 = f2;
                s2=*pnewpf++;
                f2=*pnewpf++;
                fdiff = f2 - f1;

                sdiff = s2 - s1;
        }
        deltafrq = ((n - s1) * fdiff)/ sdiff;
        return( f1 + deltafrq);
}

/*----function to get 1 frame of reflection coeff. */
readrc(rcoef,index)
float *rcoef;
int index;
{
        long startbyte;
        float *pfl1,*pfl2,*pfll;
        startbyte = index * NCF;
        for(pfl1=trcoef+startbyte,pfl2=rcoef,pfll=rcoef+NCF;
        pfl2<pfll;*pfl2++ = *pfl1++);
}

/*----function to add n excitation samples and refl.coef.
 *    to output message */
savex(out, rcoef, n)
short *out;
float *rcoef;
int n;
{
        /* ... */
}
```

```
/*----function to add repeat flag and refl.coef. to output
 *    message */
savrpt(rptflg, rcoef)
float *rcoef;
int rptflg;
{
            /* ... */
}
```

```
/*----function to fill n buffer locations with zero valued
 *    samples */
zeros( out, n)
short *out;
int n;
{       for( ; n>0; --n)
                *out++ = 0;
}
```

What is claimed is:

1. Apparatus for coding a speech pattern comprising:

means for partitioning said speech pattern into successive time frame portions;

means responsive to each successive time frame portion of the speech pattern for generating speech parameter signals comprising a set of linear predictive parameter type spectral representative signals and an excitation signal comprising a sequence of excitation pulses each of amplitude beta and location m within said time frame;

means responsive to the frame speech parameter signals for identifying successive intervals of said speech pattern as voiced or other than voiced, each voiced interval being a plurality of time frame portions coextensive with a pitch period of said speech pattern and each other than voiced interval comprising a time frame portion of said speech pattern; and means for modifying the excitation signals of each successive identified voiced interval to compress the speech pattern excitation signals of said speech pattern;

said modifying means including:

means responsive to each other than voiced interval for forming an excitation signal comprising the sequence of excitation pulses of the time frame portion of the other than voiced interval;

means responsive to the occurrence of a succession of identified voiced intervals for forming an excitation signal comprising the sequence of excitation pulses of the pitch period of a selected one of said succession of identified voiced intervals; and means for forming an excitation signal for each of the remaining voiced intervals of said succession of identified voiced intervals comprising a coded signal repeating the sequence of excitation signals of the pitch period of said selected identified voiced interval.

2. Apparatus for coding a speech pattern according to claim 1 wherein:

the means for selecting of one of a sequence of successive voiced excitation signal intervals comprises means for selecting the first of a succession of voiced excitation signal intervals; and said substituting means comprises means for generating a predetermined code and for replacing the excitation signals of the remaining succession of voiced excitation intervals with said predetermined code.

3. Apparatus for coding a speech pattern according to claim 1 further comprising means for generating a signal for editing the excitation signals of said voiced excitation signal intervals; and said modifying means comprises means responsive to said predetermined pattern editing signal for altering the excitation signals of the voiced excitation signal intervals.

4. Apparatus for coding a speech pattern according to claim 3 wherein said editing signal comprises a signal for changing the duration of the voiced excitation signal intervals and said modifying means comprises means responsive to said duration change signal for altering the excitation signal of each voiced excitation signal interval to effect a change in speaking rate.

5. Apparatus for coding a speech pattern according to claim 3 wherein said editing signal comprises a succession of duration changing signals and said modifying means comprises means responsive to the succession of duration change signals for altering the excitation signal of the excitation signal intervals of said speech pattern to effect of a change in intonation of said speech pattern.

6. A method for altering a speech message comprising the steps of:

generating a time frame sequence of speech parameter signals representative of a speech message, each time frame speech parameter signal including a set of spectral representative signals and an excitation signal comprising a sequence of excitation pulses of varying amplitudes and varying locations within the time frame;

generating a sequence of speech message time frame editing signals;

identifying a succession of prescribed type excitation signal intervals, said succession being identified in response to groups of the time frame speech parameter signals having various pitch periods;

modifying the excitation and spectral representative signals of the frames of the prescribed type excitation signal intervals in response to said speech message editing signals; and forming an edited speech message responsive to the modified excitation and spectral representative signals.

7. A method for altering a speech message according to claim 6 wherein:

the speech message editing signal generating step comprises generating a signal representative of a prescribed speaking rate;

said prescribed type of excitation signal interval is a voiced excitation signal interval;

and said modifying step comprises modifying the number of pitch periods employed to constitute each voiced excitation signal interval in response to said prescribed speaking rate editing signal.

8. A method for altering a speech message according to claim 6 wherein:

said prescribed type excitation signal interval is a voiced excitation signal interval;

the speech message editing signal generating step comprises generating a sequence of voiced interval duration changing signals; and said modifying step comprises altering the duration of the succession of voiced excitation signal intervals responsive to said duration changing speech message editing signals to modify the intonation pattern of the speech message.

9. Apparatus for altering a speech message comprising:

means responsive to the speech message for generating a time frame sequence of speech parameter signals representative of a speech message, each time frame speech parameter signal including a set of spectral representative signals and an excitation signal of the multi-pulse type;

means responsive to the time frame speech parameter signals for identifying a succession of pitch period signal intervals;

means for generating a sequence of speech message time frame editing signals responsive in part to the identifying means;

means responsive to said speech message editing signals for increasing the repetitiveness of at least some of the excitation and spectral representative signals of the frames of the pitch period signal intervals; and means responsive to the modified excitation and spectral representative signals for forming an edited speech message.

10. Apparatus for altering a speech message according to claim 9 wherein:

the speech message editing signal generating means comprises means for generating a signal representative of a prescribed speaking rate;

said prescribed type of excitation signal interval is a voiced excitation signal interval;

and said modifying means comprises means responsive to said prescribed speaking rate editing signal for changing the number of pitch periods representing each voiced excitation signal interval.

11. Apparatus for altering a speech message according to claim 9 wherein:

said prescribed type excitation signal interval is a voiced excitation signal interval;

the speech message editing signal generating means comprises means for generating a sequence of voiced interval duration changing signals; and said modifying means comprises means responsive to said duration changing speech message editing signals for altering the duration of the succession of voiced excitation signal intervals to change the intonation pattern of the speech message.

12. A method for altering a speech message coded as a sequence of time frame spectral representative signals and multi-pulse excitation signals comprising the steps of:

generating a predetermined speech message editing signal;

identifying prescribed type intervals in the excitation signal sequence of the coded speech message; and increasing the repetitiveness of the multi-pulse excitation signals of selected prescribed type intervals responsive to said speech message editing signal.

13. A method for altering a speech message according to claim 12 wherein:

said speech message editing signal comprises an interval repeat signal; and said modifying step comprises detecting a sequence of successive prescribed type excitation signal intervals, selecting one of said successive prescribed type excitation signal intervals, and substituting the excitation signal of the selected interval for the excitation signals of the remaining intervals of the sequence responsive to said interval repeat signal.

14. A method for altering a speech message according to claim 13 wherein:

said speech message editing signal comprises a speaking rate change signal; and said modifying step comprises detecting prescribed type excitation signal intervals in said coded speech message, and changing the number of time frames of the excitation signals of said detected intervals responsive to said speaking rate change signal.

15. A method for altering a speech message according to claim 13 wherein:

said speech message editing signal comprises a sequence of pitch frequency modifying signals; and said modifying step comprises detecting the successive prescribed type excitation signal intervals, and changing the duration of the excitation signals of successive detected intervals responsive to the sequence of pitch frequency modifying signals.

16. A method for altering a speech message according to claims 12, 13, 14, or 15 wherein the prescribed type excitation signal intervals are voiced intervals of the speech message.

17. A method for altering a speech message according to claims 12, 13, 14, or 15 wherein each time frame excitation signal corresponds to the linear predictive residual of the time frame.

18. Apparatus for altering a speech message coded as a time frame sequence of spectral representative and multi-pulse excitation signals comprising:

means for generating a predetermined speech message editing signal;

means responsive to said speech message spectral representative and excitation signals for identifying prescribed type sequential intervals of the at-least-partially voiced type in the excitation signal sequence of the coded speech message; and means responsive to said speech message editing signal for increasing the repetitiveness of the excitation signals of the identified prescribed type intervals by repeating a selected group of multi-pulse excitation signals representative of one such interval in the other sequential intervals to reduce the effective bit rate of the resulting coded speech message.

19. Apparatus for altering a speech message according to claim 18 wherein:

said speech message editing signal generating means comprises means for generating an interval repeat signal; and said modifying means comprises means for detecting a sequence of successive voiced excitation signal intervals, means for selecting one of said successive prescribed type excitation signal intervals, and means responsive to said interval repeat signal for substituting the excitation signal of the selected interval for the excitation signals of the remaining intervals of the sequence.

20. Apparatus for altering a speech message according to claim 18 wherein:

said speech message editing signal generating means comprises means for generating a speaking rate change signal; and said modifying means comprises means for detecting the prescribed type excitation signal intervals in said coded speech message, and means responsive to said speaking rate change signal for changing the number of time frame portions of the excitation signals of said detected intervals.

21. Apparatus for altering a speech message according to claim 18 wherein:

said speech message editing signal generating means comprises means for generating a sequence of pitch frequency modifying signals; and said modifying means comprises means for detecting the successive prescribed type excitation signal intervals, and means responsive to said sequence of pitch frequency modifying signals for changing duration of the the excitation signals of successive detected intervals.

22. Apparatus for altering a speech message according to claim 21 in which modifying means comprises means for changing the number of zero-valued pulses in the multi-pulse excitation signal to change its duration.

* * * * *